US007013215B2

(12) United States Patent
Armstrong et al.

(10) Patent No.: US 7,013,215 B2
(45) Date of Patent: Mar. 14, 2006

(54) METHOD FOR DETERMINING THE CHARGE OF AN ACTIVATED CARBON CONTAINER IN A TANK VENTILATION SYSTEM

(75) Inventors: Neil Armstrong, Remseck (DE); Peter Hohner, Stuttgart (DE); Anton Waltner, Korb (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 11/018,420

(22) Filed: Dec. 21, 2004

(65) Prior Publication Data

US 2005/0154525 A1 Jul. 14, 2005

Related U.S. Application Data

(63) Continuation-in-part of application No. PCT/EP2003/004651, filed on May 3, 2003.

(30) Foreign Application Priority Data

Jun. 22, 2002 (DE) ..... 102 28 004

(51) Int. Cl.
*F02M 33/02* (2006.01)

(52) U.S. Cl. ..... 701/114; 123/520; 701/109; 701/104

(58) Field of Classification Search ..... 701/114, 701/109, 103, 104; 123/519, 520
See application file for complete search history.

(56) References Cited

U.S. PATENT DOCUMENTS

| | | | | |
|---|---|---|---|---|
| 5,988,151 | A * | 11/1999 | Schneider | 123/520 |
| 6,561,166 | B1 * | 5/2003 | Halleron et al. | 123/519 |
| 6,725,836 | B1 * | 4/2004 | Boerkel | 123/520 |
| 2001/0052339 | A1 | 12/2001 | Halleron et al. | 123/519 |

FOREIGN PATENT DOCUMENTS

| | | |
|---|---|---|
| DE | 44 08 647 | 9/1994 |
| DE | 196 17 386 | 7/1997 |
| DE | 197 01 353 | 3/1998 |
| DE | 100 19 007 | 11/2000 |
| DE | 199 47 080 | 1/2001 |
| DE | 199 47 097 | 1/2001 |
| DE | 100 43 699 | 3/2002 |
| DE | 101 28 008 | 3/2002 |
| DE | WO 02/070872 | 9/2002 |
| EP | 0 896 136 | 2/1999 |
| EP | 1 074 706 | 2/2001 |

* cited by examiner

*Primary Examiner*—Hieu T. Vo
(74) *Attorney, Agent, or Firm*—Klaus J. Bach

(57) ABSTRACT

In a method for determining the charge of an activated carbon container of a tank venting system of a gasoline engine on the basis of the thermal influence of the tank venting system on the exhaust gas of the engine, an exhaust gas temperature measured downstream of a catalytic converter of the engine with the tank venting system activated is compared with a calculated or measured exhaust gas temperature obtained for the same location with the tank venting system inactivated and divided by the exhaust gas temperature measured with the tank venting system activated so as to obtain a temperature quotient on the basis of which the charge of the carbon container is determined.

13 Claims, 5 Drawing Sheets

METHOD FOR DETERMINING THE CHARGE OF AN ACTIVATED CARBON CONTAINER IN A TANK VENTILATION SYSTEM

This is a Continuation-In-Part Application of International application PCT/EP2003/004651 filed May 3, 2003 and claiming the priority of German application 102 28 004.5 filed Jun. 22, 2002.

BACKGROUND OF THE INVENTION

The invention relates to a method for determining the charge of an activated carbon container in a tank venting system particularly of a gasoline engine with direct fuel injection wherein the thermal influence of the tank ventilation on the engine and the charge of the activated carbon container which is determined based on the thermal influence wherein an exhaust gas temperature of a catalytic converter is determined with an activated and an inactivated tank venting system and the two temperatures are compared.

Gasoline engines with direct fuel injection include injection valves or injectors which inject the fuel directly into the cylinders of the engine. Depending on the point in time of the fuel injection into the cylinders the operating modes of the engine are designated: If fuel is injected during suction of air into the cylinder, so that the fuel injected has sufficient time to be uniformly distributed throughout the cylinder, the operation of the gasoline engine is called a homogeneous operation. The homogeneous operation is essentially the same as the known combustion methods with fuel injection into the intake ducts. In the ideal case of a homogeneous operation, the fuel is completely burnt. If the fuel is injected only during the compression stroke, that is, shortly before ignition, the fuel does not have sufficient time to be distributed over the whole combustion chamber. Then a mixture cloud is formed near the spark plug while the remainder of the combustion chamber is filled with air. This method of operation is called stratified charge operation. In this case, ideally the whole mixture in the cloud is burnt.

Intermediate states between a homogeneous and stratified operation are also possible if for example fuel is injected into the intake duct or the fuel is injected into the cylinder early during the intake stroke or late during the compression stroke.

In this case, independently of the mixture composition only the mixture in the cloud burns completely. The remaining mixture which is homogeneously distributed throughout the combustion chamber is discharged through the exhaust passage in the form of unburned HC emissions. Through the exhaust duct, the unburnt hydrocarbons reach the catalytic converter in which they are converted, together with the excess air in the stratified charge, to water and carbon dioxide. This conversion in the catalytic converter is exothermic and increases the temperature of the catalytic converter and of the exhaust gas.

When designing a gasoline engine consideration has also to be given to the evaporation of fuel that is hydrocarbons from the tank into the atmosphere. This environmentally adverse effect becomes more prevalent with an increase of the fuel temperature in the tank. With the use of activated carbon containers, which store the hydrocarbons evaporating from the tank, the legal requirements (shed-test) in connection with vaporization losses can be fulfilled. In this case, the tank is vented solely by way of the activated carbon container. However, because of the limited storage capacity of the activated carbon container the activated carbon must be constantly regenerated. When the engine is operating, air is sucked in through the activated carbon container and supplied as a mixture to the engine for combustion. If, for example, 1% of the intake air consists of fuel vapors the mixture composition during homogeneous operation of the engine changes by about 20%. In order to maintain the exhaust emissions within the desired limits and to ensure smooth engine operation the introduction of the fuel vapors into the engine must be properly controlled.

To this end, the engine control unit controls a regeneration valve. The volume flow can be measured almost continuously in the operating range of the valve by means of a performance graph adaptation using the parameters load and engine speed. In certain operating ranges, the regeneration is shut off (idle) or is ineffective (for example, under full load when the vacuum in the intake duct is insufficient, or during stratified charge operation without throttling).

In addition, there is a lambda control arrangement which monitors whether the given emission limits are maintained when during regeneration fuel is added to the intake air. If too much fuel enters the air intake duct, the regeneration flow volume is reduced in order to maintain the operational behavior and the exhaust emission within an optimal range.

The surveillance of the flow volume from the tank venting system is based on the lambda control, which, during homogeneous engine operation, keeps the mixture on the lambda value of 1. The higher the percentage of fuel vapors from the tank venting system in the intake duct, the less fuel should be injected by the injectors in order to keep the engine at a constant operating state.

By way of the adjustment or, respectively, change of the fuel injection volume, the charge of the activated carbon container can therefore be determined. A suitable precondition for such a relationship is an essentially complete combustion of all the hydrocarbons.

During stratified charge operation, the engine must be slightly throttled so that a low pressure is generated and the activated carbon container can be regenerated. The hydrocarbons from the activated carbon container reach the combustion chamber homogeneously distributed in the intake air and are only partially burnt in the engine. The unburned hydrocarbons reach the catalytic converter, are converted therein chemically and increase the temperature of the catalytic converter. Hydrocarbons however cannot be measured by way of a lambda probe since the lambda probe responds only to the oxygen content in the exhaust gas.

The charge of the activated carbon container can therefore not be determined by a lambda probe during stratified charge engine operation.

DE 199 47 080 C1 discloses an apparatus and a method for the regeneration of an activated carbon container which is arranged in the tank venting system of an internal combustion engine. The engine is operated with pressurized air supported direct injection of the gasoline. At the high pressure side of an air pressurizing unit for the injection of the gasoline, a pressure controller is arranged whose discharge air is conducted through the activated carbon container for the regeneration thereof.

DE 196 17 386 C1 discloses a tank venting system for an internal combustion engine with direct fuel injection. In this case, the internal combustion engine includes a pressurized air based injection system wherein, under certain operating conditions of the internal combustion engine, the air for the regeneration of the activated carbon container of the tank venting system is admixed to the atomizing air for the injection system which is generated by means of a compressor.

Finally, DE 197 01 353 C1 discloses a tank venting system for an internal combustion engine wherein the charge level of an activated carbon filter is determined. Depending on the charge level and a predetermined value for a maximum fuel mass flow through the tank venting valve a desired flushing flow is calculated and the actuating ratio for the tank venting valve is adjusted depending on the desired flushing flow. The temperature of the flushing flow and the pressure differential at the tank venting valve are so adjusted, that the lambda deviation of a controller of the lambda control arrangement caused by the flushing does not exceed a predetermined maximum value.

It is the object of the present invention to provide a method by which the charge state of an activated carbon container in the venting system of an internal combustion engine can be determined in a simple way.

SUMMARY OF THE INVENTION

In a method for determining the charge of an activated carbon container of a tank venting system of a gasoline engine on the basis of the thermal influence of the tank venting system on the exhaust gas of the engine, an exhaust gas temperature measured downstream of a catalytic converter of the engine with the tank venting system activated is compared with a calculated or measured exhaust gas temperature obtained for the same location with the tank venting system inactivated and divided by the exhaust gas temperature measured with the tank venting system activated so as to obtain a temperature quotient on the basis of which the charge of the carbon container is determined.

With the method described, the charge state of an activated carbon container can be determined in a simple manner so that, based on the charge state, taking into consideration a desired fuel-air ratio, the venting of the tank, that is the regeneration of the activated carbon container, can be controlled in an optimal way.

In a preferred embodiment of the method according to the invention, during venting of the tank an exhaust gas temperature, which is determined downstream of a catalytic converter of the gasoline engine, is compared with the exhaust gas temperatures determined with an inactivated tank venting system. Such a comparison between the exhaust gas temperatures obtained with activated and inactivated tank venting system (with otherwise identical engine operating parameters) provides, in a simple manner, for conclusions concerning the charge state of the activated carbon container.

It is advantageous if the exhaust gas temperatures are calculated for different operating conditions of the engine with inactivated tank venting by means of a model and divided by the exhaust gas temperatures measured with an activated tank venting system with identical engine operating conditions. In this way, a temperature ratio is obtained from which the charge of the activated carbon container can be calculated or derived on the basis of a respective predetermined performance graph. This procedure has relatively little measuring requirements.

If the model described is not sufficiently accurate, it is expedient to determine the exhaust gas temperatures also with inactivated venting system and to store the values in a performance graph dependent on the engine speed and engine load. Then, the exhaust gas temperature is measured with subsequently activated tank venting system and the values are divided by the stored exhaust gas temperature values in order to determine the charge of the activated carbon container on the basis of the temperature ratio obtained in this way.

This method has been found in practice to be very accurate and reliable.

Instead of measuring or, respectively, considering the temperatures only downstream of the catalytic converter, it is in accordance with another preferred embodiment of the invention also possible to determine the exhaust gas temperatures upstream and downstream of the catalytic converter with inactivated or, respectively, activated tank venting system. In this procedure, the calculations or measurements are performed on the basis of the temperatures so determined and the temperature differences under the respective engine operating conditions and, with corresponding correlations of the temperature differences obtained for activated and inactivated venting system, conclusions concerning the charge state of the activated carbon container can be obtained. With such a determination, the heat generation in the catalytic converter, that is the temperature increase thereof by the conversion of unburnt hydrocarbons, it is necessary to calculate or use absolute exhaust gas temperatures whereby the computing models are greatly simplified.

Expediently, a regeneration valve of a tank venting system is controlled on the basis of the determined charge state of the activated carbon container.

The regeneration value is expediently controlled depending on the exhaust gas temperature, an engine speed, an engine load operating point of the engine, a charge of the activated carbon container and/or the engine operating mode (homogeneous or stratified charge) or a combination of these parameters.

In accordance with the invention gasoline engines are expediently provided with thermo-elements arranged downstream and/or upstream of a catalytic converter of the gasoline engine for determining the respective exhaust gas temperatures. With such thermo-elements, the exhaust gas temperatures can be measured in a simple and reliable manner so that the procedures described herein can be reliably performed.

Expediently, the gasoline engine includes a computer such as an engine control unit for performing the method according to the invention.

With the method according to the invention, higher regeneration rates can be achieved than with conventional solutions, since, in accordance with the present method, the activated carbon tank can also be regenerated during stratified charge engine operation. Also, the engine can be operated over longer periods in the stratified charge operating mode since the activated carbon tank can be regenerated in the homogeneous as well as the stratified charge engine operating mode. This results overall in lower fuel consumption. Regeneration of the activated carbon container in all engine operating modes provides furthermore for lower emissions of unburned hydrocarbons.

Below the invention will be described in greater detail on the basis of the accompanying drawings.

DESCRIPTION OF PREFERRED EMBODIMENTS

Figure 1:
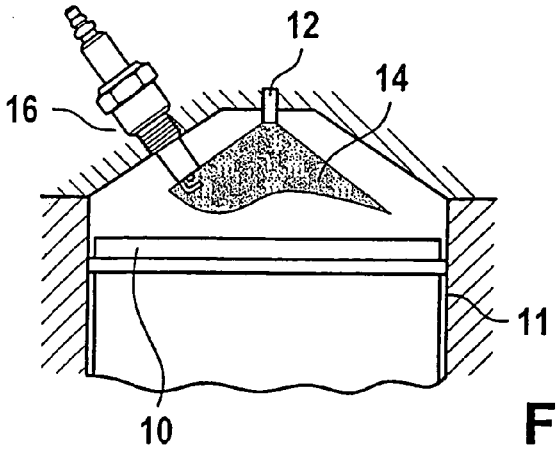
FIG. 1 shows schematically the fuel injection components of a gasoline engine with direct fuel injection.

As shown in FIG. 1, in a gasoline engine with direct fuel injection, the fuel is injected by means of a fuel injector 12 directly into a cylinder 11 in which a piston 10 is disposed. The cone-like injection beam formed thereby is schematically shown and is designated by the reference numeral 14. There are means for the addition of air or, respectively, unburned hydrocarbons from the tank venting system to the cylinder 11 which however are not shown in FIG. 1.

The cylinder 11 is also provided with a spark plug 16.

Figure 2:
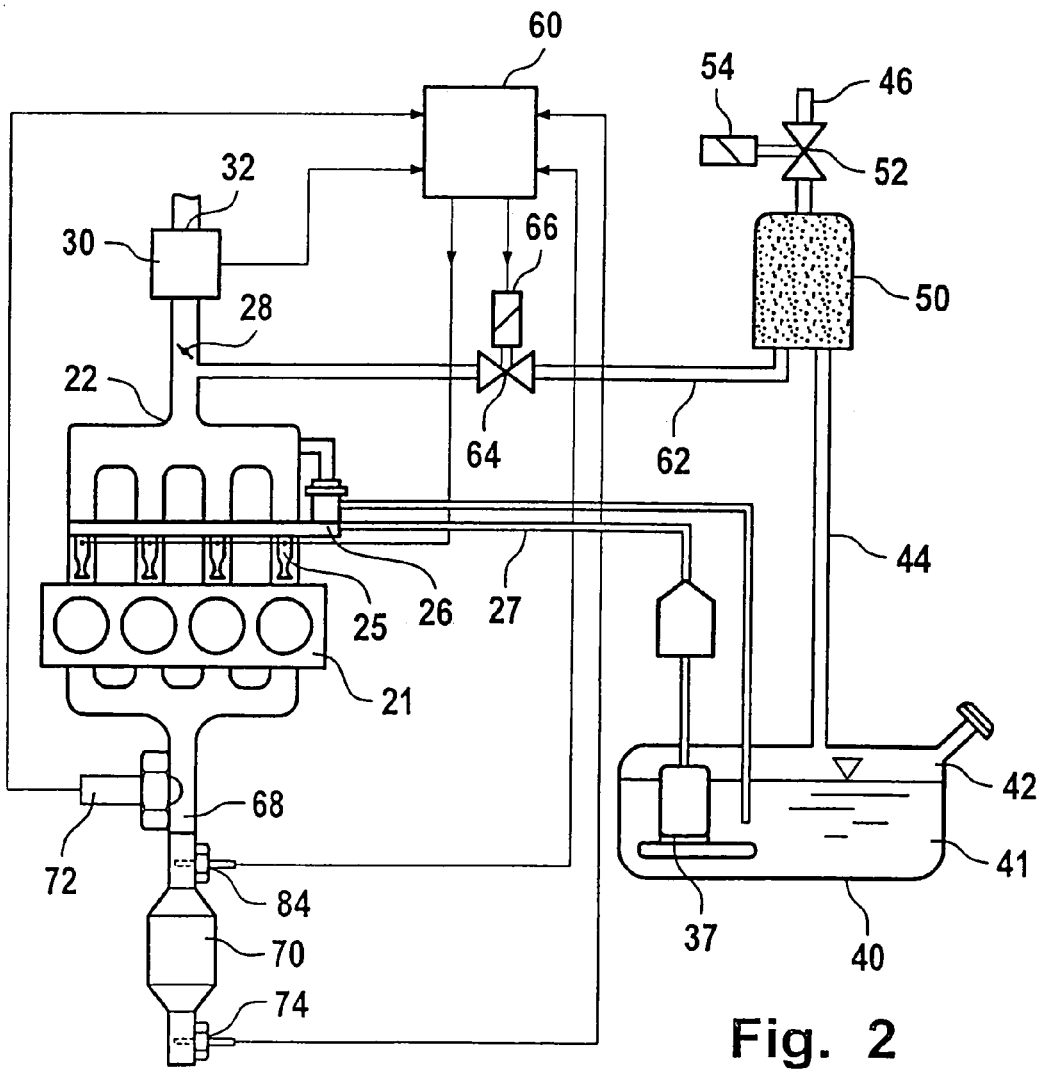
FIG. 2 shows schematically the essential components of a tank venting system of a gasoline engine.

FIG. 2 shows schematically an internal combustion engine 21 which includes an intake duct 22 for the admission of air to the engine 21. By way of injection valves 25 to which fuel is supplied from a fuel injection rail 26 fuel is injected directly into the cylinders of the internal combustion engine. In the intake duct 22, there is a throttle 28 and, upstream of the throttle 28, an air mass flow meter 30 with an intake opening 32 for the admission of intake air.

Fuel is supplied to the fuel injection rail 26 by way of a fuel supply line 27 connected to a pump unit 32, which is arranged in the fuel tank 40.

The tank 40 contains fuel 41. Above the fuel 41, there is a space filled with fuel vapors 42. The tank 40 is further in communication with the ambient by way of a tank venting line 44, which extends to a vent connection 46 for pressure equalization.

The tank venting line 44 includes an activated carbon container 50, which includes hydrocarbon-absorbing activated carbon material. With this measure, it is ensured that no hydrocarbons from the tank venting line 44 are discharged to the vent line connection 46 since the hydrocarbons are all absorbed by the activated carbon material.

Between the vent connection 46 and the activated carbon container 50, the vent line includes a valve 52 which can be operated by a controller 54. The controller 54 is operable by a motor control unit 60 via control lines which are not shown.

The activated carbon container 50 has a second exit to which a regeneration line 62 is connected which extends to the intake duct 2 of the internal combustion engine 21.

The regeneration line 62 includes a regeneration valve 64, which is operable by an operator 66. The regeneration valve 64 is generally called a tank venting valve.

The control unit 60 is connected by communication lines which are only partially shown to the air mass flow meter 30 of the throttle 28, the injection valves 25 and the operator 66 of the regeneration valve 64 and, by way of these communication lines, reads measuring values and, respectively, supplies control signals to the respective components.

The activated carbon container 50 absorbs the fuel vapors entering by way of its inlet from the tank 40. In order to prevent that hydrocarbons reach the vent connection 46 when the activated carbon container is fully charged the activated carbon container 50 is regenerated during operation of the engine. To this end, by switching of the regeneration valve 64, the regeneration line 62 from the activated carbon container 50 to the intake duct 22 is opened. At the same time, the discharge valve 52 is closed so that the outlet of the activated carbon container 50 associated with this valve 52 is blocked. Then it is possible to admit air to the activated carbon container 50 by way of a (not shown) line. With the regeneration valve 64 open, the air flows through the regeneration line 62 while carrying along the fuel vapors from the activated carbon container 50 to the intake duct 22.

It has already been pointed out that, with the addition of for example 1% of the intake air in the form of fuel vapors, the mixture composition changes in a homogeneous operation of the engine by about 20%. In order to keep the exhaust gas emissions within the desired limits and to ensure smooth operation of the engine, the regeneration valve 64 is controlled by the engine control unit 60 so as to provide for a controlled introduction of fuel vapors into the intake air. The flow-through volume can be controlled in the operating range of the regeneration valve almost infinitely by means of a performance graph adaptation using the parameters load and engine speed. In certain operating ranges, the regeneration is shut down (for example, during idle) or it is ineffective. As already mentioned, during homogeneous charge engine operation, the charge of the activated carbon filter 50 can be determined by the deviation of the fuel injection volume.

It has further already been pointed out that, during stratified charge engine operation, the engine needs to be slightly throttled in order to permit regeneration of the activated carbon container by the vacuum generated thereby. The hydrocarbons from the activated carbon container are homogeneously distributed in the combustion chamber and are only partially burnt. Unburnt hydrocarbons reach the catalytic converter 70 via the exhaust duct 68 and are chemically converted in the catalytic converter thereby increasing the temperature of the catalytic converter.

However, the hydrocarbons cannot be measured by means of the lambda probe 72 since the lambda probe reacts only to the oxygen content in the exhaust gas. A determination of the charge of the activated carbon container 50 is therefore not possible with the lambda probe 72 during stratified charge engine operation.

Therefore a thermoelement 74 is arranged downstream of the catalytic converter 70 by which the temperature of the exhaust gas downstream of the catalytic converter is measured. Based on the difference between the exhaust gas temperatures with activated and inactivated venting system the charge state of the activated carbon container can be reasonably well determined.

Figure 3:
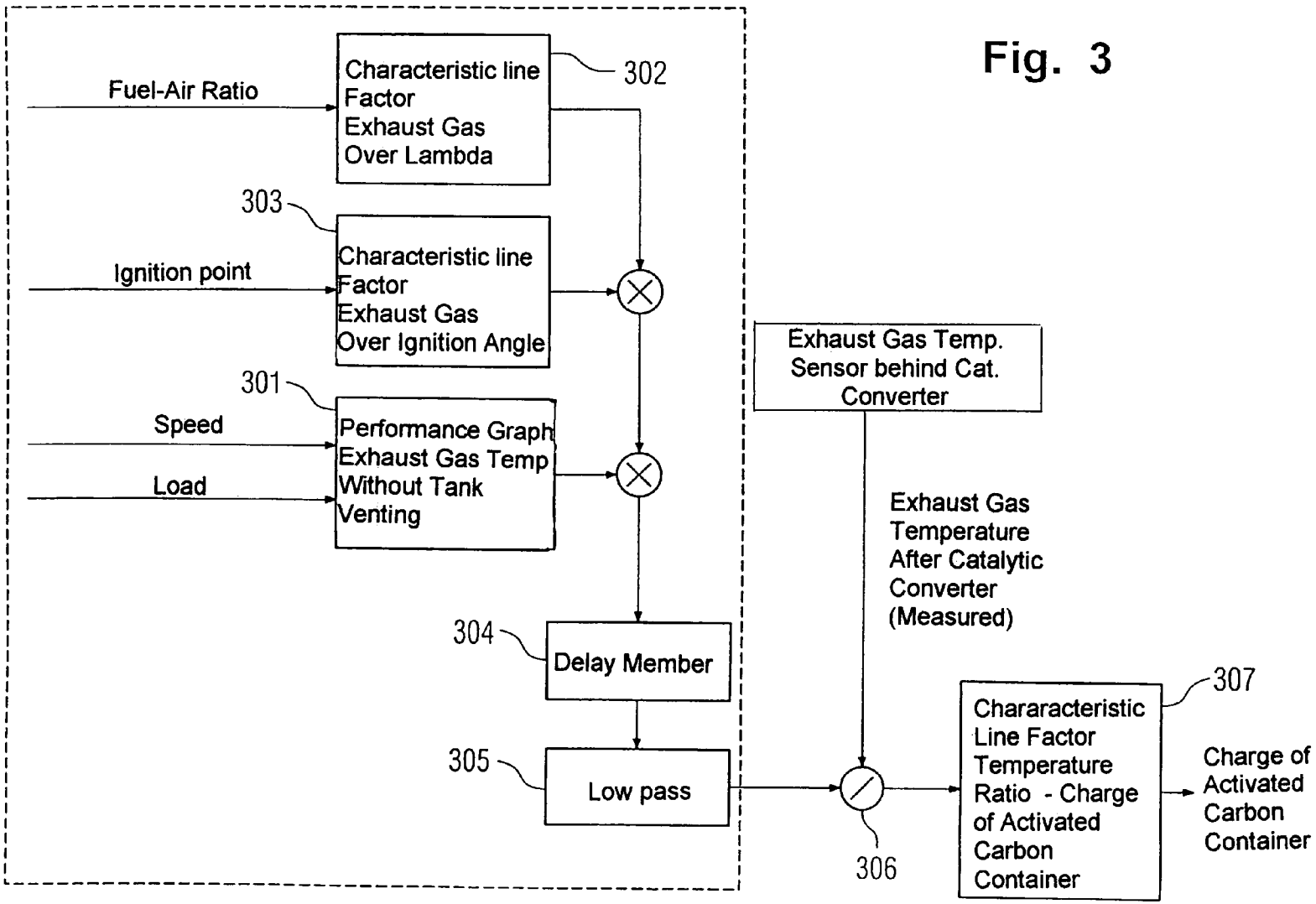
FIG. 3 shows a diagram representing a first embodiment of the method according to the invention.

The determination of the charge of the activated carbon container 50 can be realized in various ways. First, as indicated in FIG. 3, the possibility of a comparison of a calculated exhaust gas temperature without tank venting with a measured exhaust gas temperature (with activated tank venting system) is considered.

With a comparison of a calculated exhaust gas temperature (without fuel tank venting) and a measured exhaust gas temperature (with fuel tank venting) first, in a step 301, from a performance graph based on engine speed and engine load the exhaust gas temperature is determined without corrections. By means of two additional characteristic lines, the influences of the fuel air ratio (lambda) and the ignition time are computed as factors into the exhaust gas temperature. The set up of the characteristic line for the exhaust gas temperature over lambda is performed on the basis of the fuel-air ratio in a step 302 and the characteristic line for the exhaust gas temperature over an ignition angle is obtained on the basis of the ignition time in a step 303.

Any change of engine speed, engine load, ignition time or lambda becomes effective on the exhaust gas temperature downstream of the catalytic converter only with a certain time delay since the gas volume has to flow first through the engine 21 and then through the catalytic converter 70. Furthermore, with such a change, the motor, the exhaust gas duct and the catalytic converter must first be heated or, respectively, cooled down. These facts are taken into consideration by means of low pass filtering in a step 305, wherein ahead of the step 305 expediently a delay is provided for by means of a delay member in a step 304.

The value for the exhaust gas temperature without tank venting obtained (calculated) in this way is divided in step 306 by the temperature determined (measured) in the exhaust gas duct downstream of the catalytic converter 70 by means of the temperature sensor 74. If the unburnt HC parts of the tank venting system are converted in the catalytic converter during the stratified charge operation the temperature of the exhaust gas is (measurably) increased whereby a factor for the temperature ratio of >1 is obtained. This temperature ratio serves as input value of a characteristic line, in which the conversion to the actual charge of the activated carbon container occurs (Step 307).

If the temperature model which was used in connection with the algorithm presented in FIG. 3 is too inaccurate for a sufficiently accurate determination of the charge of the activated carbon container 50, the charge of the activated carbon container 50 may also be determined by way of an algorithm with an adaptation of the exhaust gas temperature. Such a method will now be described with reference to FIG. 4. In this case, in a step 401, the measured exhaust gas temperature without tank venting is determined and stored in a performance graph which is based on the engine speed and load, in each case within certain performance graph areas. This determination or respectively measurement is performed only with the tank venting system activated in order to establish a base state. For a determination of the exhaust gas temperature without tank ventilation, it is expedient to operate the engine throughout all performance graph areas. The difference with regard to the algorithm described with reference to FIG. 3 resides in the fact that, in the present case, exhaust gas temperatures are measured depending on the respective engine speed and engine load values. In accordance with the algorithm as described with reference to FIG. 3, the exhaust gas temperatures are calculated with inactivated tank venting system in the way described on the basis of the parameters or, respectively, characteristic numbers mentioned.

Figure 4:
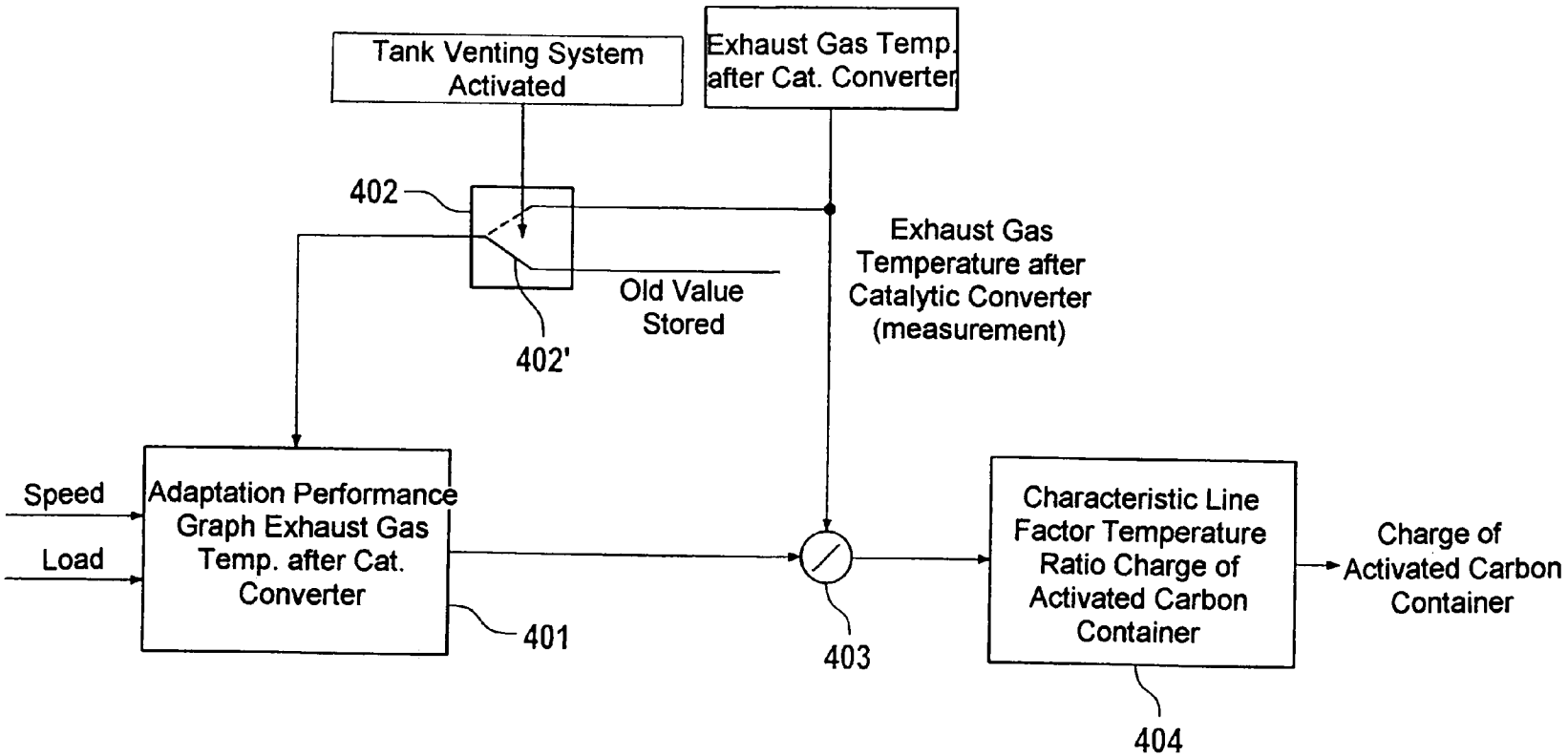
FIG. 4 shows a diagram representing a second embodiment of the method according to the invention.

In FIG. 4, the performance graph determination is symbolized at 402 by means of a dashed position of a switch 402'. In this position of the switch, a correlation between the temperatures measured with inactivated tank venting system and the parameters load and speed is possible.

When all the performance graph areas have been run through or respectively, determined the tank ventilation system is activated at 402. After the activation of the tank ventilation system, the values for the exhaust gas temperatures in the performance graph are not changed any more (symbolized by a second solid line position of the switch 402').

The values determined in this way are divided by the temperature of the exhaust gas as measured by the thermoelement 74 downstream of the catalytic converter. The charge of the activated carbon container is then determined in a way analogous to the method described for FIG. 3 using the exhaust gas temperature model via the formation of a ratio and conversion by means of a characteristic line (step 404).

Another possibility for determining the heat generation in the catalytic converter 50, that is the release of heat by the conversion of unburnt hydrocarbons, resides in the measurement of the exhaust gas temperature ahead of, and after, the catalytic converter. To this end, another thermoelement 84 is arranged ahead of and, respectively, after the catalytic converter 70. A corresponding procedure is represented in FIG. 5.

Figure 5:
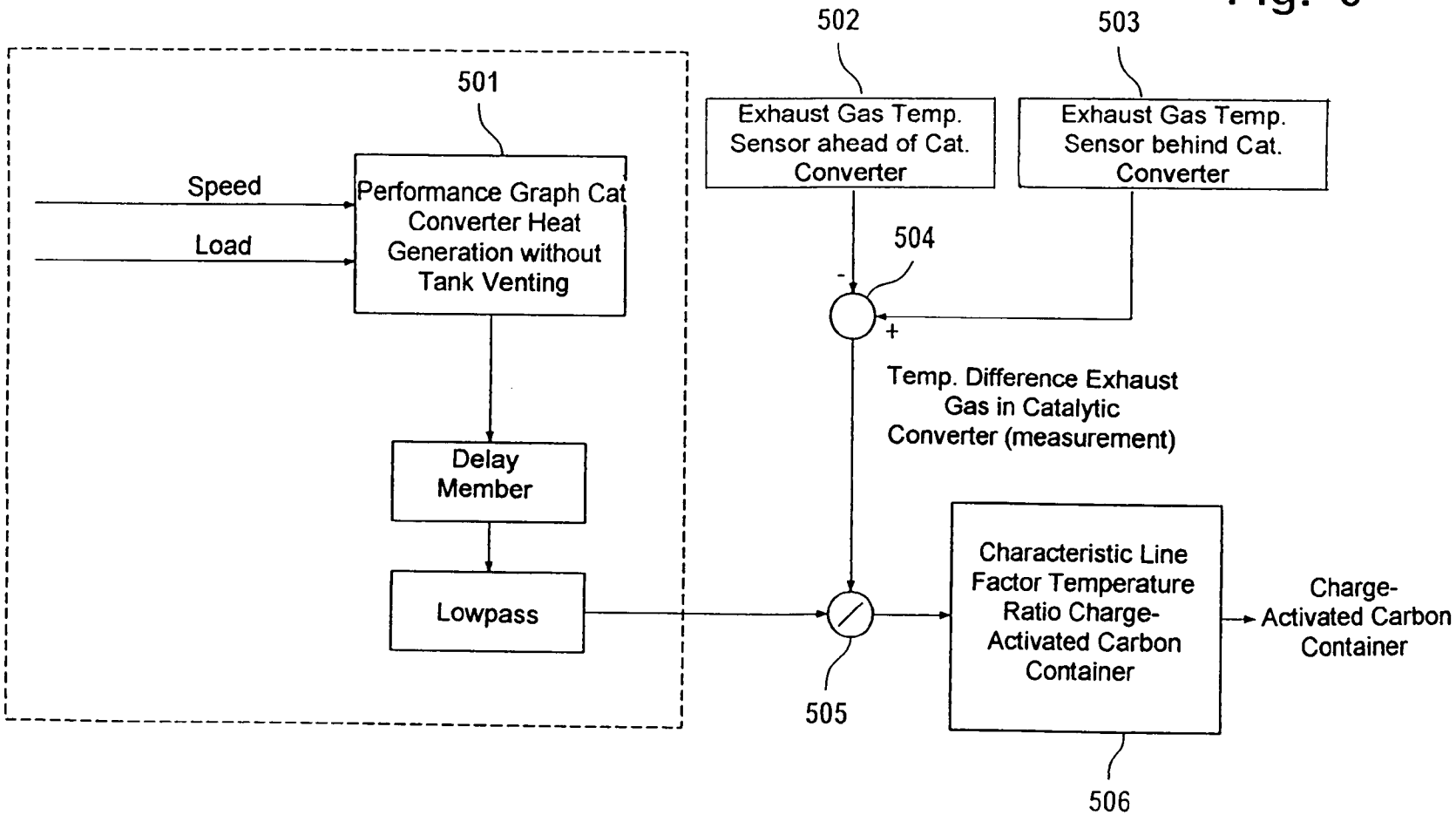
FIG. 5 shows a diagram representing a third embodiment of the method according to the invention.

In the method according to FIG. 5, a performance graph for a catalytic converter heat generation with inactivated tank venting system is calculated in a step 501 based on engine speed and engine load. In steps 502 and 503, the exhaust gas temperatures ahead of and after the catalytic converter are measured. In a step 504, the difference between the measured temperatures is determined. The values of the performance graph determined in step 501 which are again modified by means of a delay member and a low pass are correlated in a step 505 with the temperature difference determined in step 504 forming a ratio. From the characteristic line of the temperature ratio obtained in this way the charge of the activated carbon container 50 is determined (step 506).

The advantages obtained particularly with respect to the method as shown in FIG. 3 reside in the fact that, in this case, the absolute exhaust gas temperature which depends not only on the engine speed and the load but also on the ignition timing, lambda, etc. does not need to be known. Therefore the exhaust gas temperature model as described in FIG. 3 is simplified to a catalytic converter heat generation model depending only an engine speed and engine load.

Figure 6:
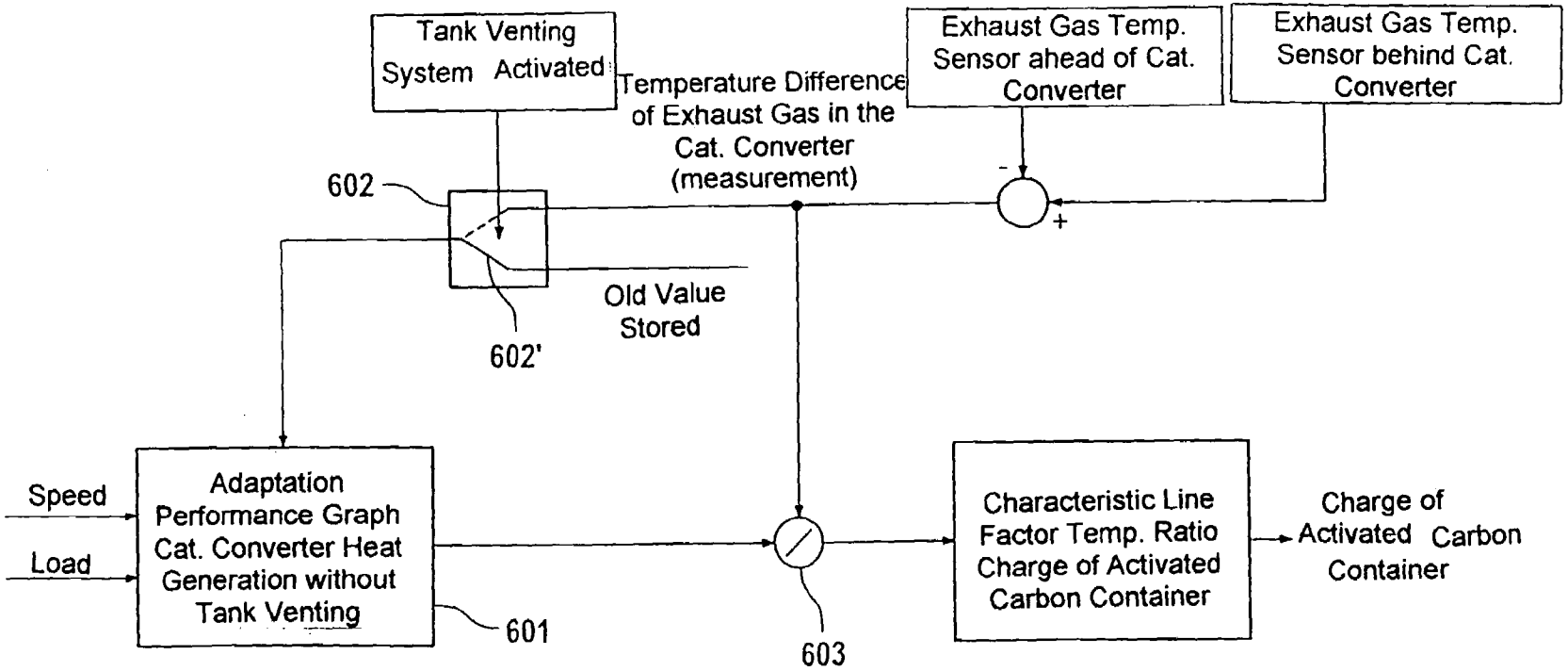
FIG. 6 shows a diagram representing a fourth embodiment of the method according to the invention.

With the method described in FIG. 4, the possibility was mentioned to measure the exhaust gas temperature for different performance graph areas, that is, to measure them and to store them. In an analogous manner, it is possible to determine the heat generation of the catalytic converter. A corresponding method will now be described with reference to FIG. 6. In this procedure in a step 601, with initially inactivated tank venting system the exhaust gas temperatures ahead of, and after, the catalytic converter are measured in suitable engine speed and load ranges (switch 602' at 602 as shown in the dashed line position). The temperature differences determined in this way are stored in an engine speed and engine load dependent adaptation performance graph for a catalytic converter heat generation with inactivated tank venting system. After activation of the tank ventilation system at 602 (switch 602' in the second position as indicated by the solid line) the values determined in this way are divided by the respective temperature differences measured ahead of, and after, the catalytic converter with the tank ventilation system activated (step 603). On the basis of this quotient or ratio, in step 604, the characteristic line of the quotient determined in step 603 concerning the charge of the activated carbon container 50 is determined. This algorithm again determines the catalytic converter heat generation by measurement with the tank venting system inactivated for a comparison—after the determination and learning phase—with the measured catalytic converter heat generation with activated tank ventilation system and a determination of the charge of the activated carbon container on the basis of this comparison.

Based on the methods described, the tank ventilation rate is controlled expediently so as to provide a constant exhaust gas temperature or a predetermined flow volume through the regeneration valve 64. The aim is to remove the absorbed hydrocarbons from the activated carbon container 50. Depending on the charge of the activated carbon container 50, a more or less intense regeneration can be provided for.

What is claimed is:

1. A method for determining the charge of an activated carbon container of a tank venting system of a gasoline engine having an intake duct and an exhaust duct with a catalytic converter, comprising the steps of: determining the thermal influence of the tank venting system on the exhaust gas of the gasoline engine and determining the charge of the activated carbon container on the basis of the thermal influence wherein an exhaust gas temperature measured downstream of the catalytic converter with the tank venting system activated is compared with an exhaust temperature calculated by a model or measured at the same location with the tank venting system inactivated and divided by the exhaust gas temperatures measured with the tank venting system activated so as to obtain a temperature quotient and the charge of the carbon container is determined from the temperature quotient on the basis of a corresponding performance graph.

2. A method according to claim 1, wherein the temperature differences of the exhaust gas ahead of the catalytic converter are calculated by way of a model for an inactivated venting system and divided by the corresponding temperature differences as measured by temperature sensors so as to obtain exhaust gas temperature difference quotients on the basis of which the charge of the activated carbon container is calculated or derived from corresponding performance graphs.

3. A method according to claim 1, wherein on the basis of exhaust gas temperatures measured in ahead of, and after, the catalytic converter with the tank venting system inactivated exhaust gas temperature differences are stored in a performance graph, exhaust gas temperature differences measured with the tank venting system activated are divided by the respective stored exhaust gas temperature differences, and the charge of the activated carbon container is determined on the basis of the temperature quotient obtained thereby.

4. A method according to claim 1, wherein the tank venting system includes a regeneration valve which is controlled dependent on the charge state of the activated carbon container.

5. A method according to claim 4, wherein the regeneration value is controlled depending on at least one of the exhaust gas temperature, an engine speed—engine load operating state of the engine the charge of the activated carbon container and the mode of operation of the engine.

6. A method according to claim 4, wherein the regeneration valve is controlled depending on at least one of the exhaust gas temperature, an engine speed—engine load operating state of the engine the charge of the activated carbon container and the mode of operation of the engine.

7. A gasoline engine with direct fuel injection including an intake duct (22) and an exhaust duct (22), a catalytic converter (70) arranged in the exhaust duct (68), a thermoelement (74) arranged in the exhaust duct (65) downstream of the catalytic converter, a thermoelement (84) arranged upstream of the catalytic converter (70) and control computer (60) for controlling the method steps according to claim 1.

8. A method for determining the charge of an activated carbon container of a tank venting system of a gasoline engine having an intake duct and an exhaust duct with a catalytic converter, comprising the steps of: determining the thermal influence of the tank venting system on the exhaust gas of the gasoline engine and determining the charge of the activated carbon container on the basis of the thermal influence, wherein exhaust gas temperatures are measured with the tank venting system inactivated and are stored in a performance graph which is based on engine speed and engine load and the exhaust gas temperatures are then measured with the tank venting system activated are divided by the stored values to form a temperature quotient and the charge of the activated carbon container is determined on the basis of the temperature quotients.

9. A method according to claim 8, wherein the temperature differences of the exhaust gas ahead of the catalytic converter are calculated by way of a model for an inactivated venting system and divided by the corresponding temperature differences as measured by temperature sensors so as to obtain exhaust gas temperature difference quotients on the basis of which the charge of the activated carbon container is calculated or derived from corresponding performance graphs.

10. A method according to claim 8, wherein on the basis of exhaust gas temperatures measured in ahead of, and after, the catalytic converter with the tank venting system inactivated exhaust gas temperature differences are stored in a performance graph, exhaust gas temperature differences measured with the tank venting system activated are divided by the respective stored exhaust gas temperature differences, and the charge of the activated carbon container is determined on the basis of the temperature quotient obtained thereby.

11. A method according to claim 8, wherein the tank venting system includes a regeneration valve which is controlled dependent on the charge state of the activated carbon container.

12. A method according to claim 11, wherein the regeneration valve is controlled depending on at least one of the exhaust gas temperature, an engine speed—engine load operating state of the engine the charge of the activated carbon container and the mode of operation of the engine.

13. A gasoline engine with direct fuel injection including an intake duct (22) and an exhaust duct (22), a catalytic converter (70) arranged in the exhaust duct (68), a thermoelement (74) arranged in the exhaust duct (65) downstream of the catalytic converter, a thermoelement (84) arranged upstream of the catalytic converter (70) and control computer (60) for controlling the method steps according to claim 8.

* * * * *